United States Patent [19]

Mapelsden

[11] 4,038,508

[45] July 26, 1977

[54] ELECTRICAL SWITCH METHOD OPERATING SUCH AND INDEXING SYSTEM

[75] Inventor: George C. Mapelsden, Easton, Conn.

[73] Assignee: General Electric Company, New York, N.Y.

[21] Appl. No.: 579,949

[22] Filed: May 22, 1975

[51] Int. Cl.[2] ..... H01H 3/50; H01H 19/00; G05G 5/00

[52] U.S. Cl. ..... 200/329; 74/527; 74/531; 200/17 R; 200/291; 200/336

[58] Field of Search ..... 200/1 R, 5 R, 6 R, 11, 200/17 R, 18, 291, 329, 336; 74/527, 531

[56] References Cited

U.S. PATENT DOCUMENTS

| | | | |
|---|---|---|---|
| 2,834,842 | 5/1958 | LeBeau | 74/527 |
| 2,857,783 | 10/1958 | Ranck, Jr. et al. | 74/531 |
| 3,180,177 | 4/1965 | Ford et al. | 74/531 |
| 3,198,893 | 8/1965 | Mapelsden | 200/6 |
| 3,260,805 | 7/1966 | Pihl | 74/527 X |
| 3,311,718 | 3/1967 | Allison et al. | 74/527 X |
| 3,403,580 | 10/1968 | English et al. | 74/527 |
| 3,712,151 | 1/1973 | Diehl | 74/527 |

*Primary Examiner*—James R. Scott

[57] ABSTRACT

An electrical switch has a housing with means operable generally therein for switching power through the switch. Means is rotatable in the housing between a plurality of indexed positions for actuating the switching means, and means is provided for releasably holding the actuating means in each of its indexed positions. Means is also provided for retarding the rotation of the actuating means between at least some of its indexed positions.

A method of operating an electrical switch, and an indexing system for an electrical switch are also disclosed.

38 Claims, 18 Drawing Figures

ELECTRICAL SWITCH METHOD OPERATING SUCH AND INDEXING SYSTEM

FIELD OF THE INVENTION

This invention relates generally to electrical controls and in particular to electrical switches, methods of operating an electrical switch, and an indexing system for an electrical switch.

In the past, various and sundry types of electrical switches have been provided with a switch operator rotatable therein in response to an applied force between a plurality of indexed or switch operating positions in order to actuate a plurality of switch arms for making and breaking a plurality of circuits through the switch. Of course, various indexing systems were provided in these prior electrical switches for releasably holding the switch operator in each of the indexed or switch operating positions thereof.

At least one of the disadvantageous or undersirable features of such past electrical switches is believed to be the rather fast transfer or rotation of the switch operator between its switch operating positions in response to the force applied on the switch operator. For instance, the indexing systems of the past electrical switches were operable generally to resist the applied force rotation of the switch operator until the magnitude of the applied force, or the resulting torque thereof, was increased to a value great enough to overcome the indexing system thereby to effect the release of its holding engagement with the switch operator. Upon the release of the indexing system, the applied force or torque acting on the switch operator was then operable to effect a rather rapid angular acceleration (with corresponding limited mechanical and electrical transfer time) of the switch operator between its switch operating positions. Of course, such rapid operation of the switch operator could result in deleterious arcing between the various electrical contacts of the switch arms actuated by the switch operator upon the applied force rotation of the switch operator between its switch operating positions.

SUMMARY OF THE INVENTION

Among the several objects of the present invention may be noted the provision of an electrical switch, a method of operating an electrical switch, and an indexing system for an electrical switch which overcome the disadvantageous or undesirable feature discussed above, as well as other such disadvantageous features, of the prior art electrical switches; the provision of such electrical switch, such method, and such indexing system in which the mechanical and the electrical transfer times for effecting switching is predeterminately increased thereby to retard such switching; the provision of such electrical switch, such method, and such indexing system in which friction is introduced for predeterminately increasing the electrical and the mechanical times for effecting switching; the provision of such electrical switch, such method, and such indexing system in which an applied force transfer of a switch operator between its switching positions is retarded only during a predeterined portion of its travel or transfer from one of its switch operating positions toward another thereof; the provision of such electrical switch, such method, and such indexing system in which the switching speed of the switch operator between its switch operating positions is retarded without affecting the operation of means associated with the switch operator for releasably holding it in each of its switch operating positions; and the provision of such electrical switch, such method, and such indexing system in which the components thereof are simplistic in design, easily assembled, and economically manufactured. These as well as other objects and advantageous features of the present invention will be in part apparent and in part pointed out hereinafter.

In general, an electrical switch in one form of the invention has a housing with means operable generally therein for switching power through the switch, and means is rotatable in the housing between a plurality of indexed positions for actuating the switching means. Means is provided for releasably holding the actuating means in each of its indexed positions, and means is also provided for retarding the rotation of the actuating means between at least some of its indexed positions.

Also in general and in one form of the invention, an electrical switch has a housing, and a switch operator is mounted to the housing for rotation in response to an applied force between a plurality of switch operating positions. Yieldable means for indexing engagement with the switch operator is operable generally to releasably hold the switch operator in its switch operating positions, and means is provided for retarding the angular velocity of the switch operator only during a predetermined portion of its applied force rotation from one of the switch operating positions toward another thereof.

Further in general, an indexing system for an electrical switch is provided in one form of the invention having switch operating means adapted for rotatable movement therein between a plurality of discrete switch operating positions. The indexing system comprises means associated with the switch operating means for releasably holding it in the switch operating positions thereof, and means operable independently of the releasably means for retarding the switch operating means only during a predetermined portion of its rotatable movement from one of the switch operating positions to another thereof.

In general, a method in one form of the invention is provided for operating an electrical switch having a housing, and a switch operator which is adapted for rotation in the housing between a plurality of distinct switch operating positions. In this operating method, a force is applied to the operator for rotating it from one of its switch operating positions toward another thereof, and the applied force rotation of the operator is retarded during only a preselected portion of its rotation between its one and other switch operating positions.

DETAILED DESCRIPTION OF THE PREFERRED EMBODIMENTS

Figure 2:
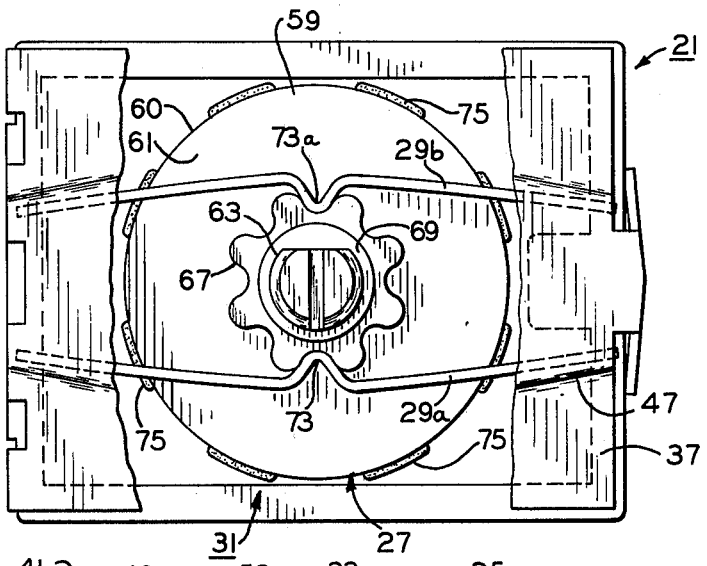
FIG. 2 is a top elevational view of the electrical switch of FIG. 1 with the cover therefor partially broken away to show the operating components of the electrical switch which illustrate an indexing system for an electrical switch in one form of the invention and which also illustrate principles for a method of operating an electrical switch in one form of the invention.
Figure 3:
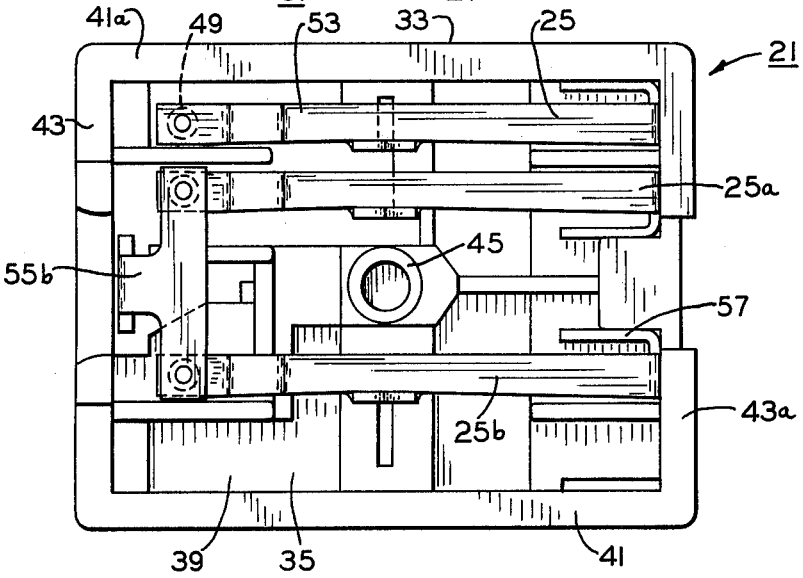
FIG. 3 is a sectional view taken generally along line 3—3 in FIG. 1.

Referring now to the drawings in general, an electrical switch 21 in one form of the invention is provided with a housing 23 (FIGS. 1-3) with means, such as switches 25, **25*a* and 25*b*, operable generally therein for switching power through the housing (FIG. 3). Means, such as switch operator 27 (FIG. 2, 4 and 5), is rotatable in housing 23 between a plurality of indexed or switch operating positions (FIG. 6) for actuating the switching means or switches 25, 25*a* and 25*b*. Means, such as leaf or indexing springs 29, 29*a* is provided for releasably holding the actuating means or switch operator 27 in each of its switch operating positions (FIG. 2), and means, indicated generally at 31, is also provided for retarding the rotation of the switch operator between at least some of its indexed positions (FIGS. 2 and 6**).

Figure 1:
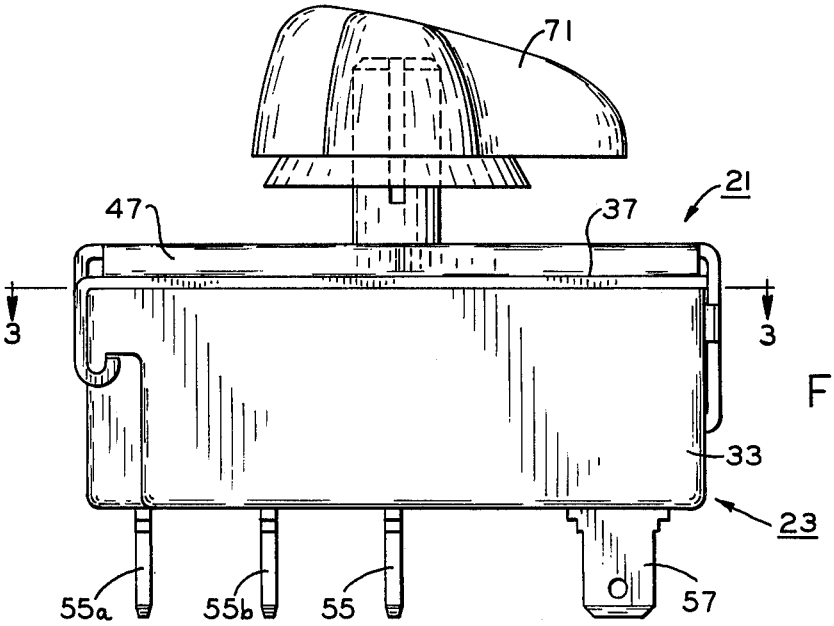
FIG. 1 is a side elevational view of an electrical switch in one form of the invention which is completely assembled.

More particularly and with specific reference to FIGS. 1-3, housing 23 of electrical switch 21 comprises a casing, such as a base or receptacle 33 of suitable dielectric material, having a chamber 35 therein and a closure member or cover 37 which may be formed of metal is snapped, crimped, or otherwise connected by suitable means over the receptacle closing the chamber therein. Receptable 33 is provided with a base wall 39 integral with a pair of opposite side walls 41, **41*a* which are also integrally interconnected between a pair of opposite end walls 43, 43*a* thereby to define chamber 35. A hub or recess 45 is centrally provided on base wall 39 of receptacle 33 in which switch operator 27 is rotatably mounted, as discussed hereinafter, and another recess 47 is provided in cover 37 for housing indexing springs 29, 29*a***, as also discussed hereinafter.

Figure 5:
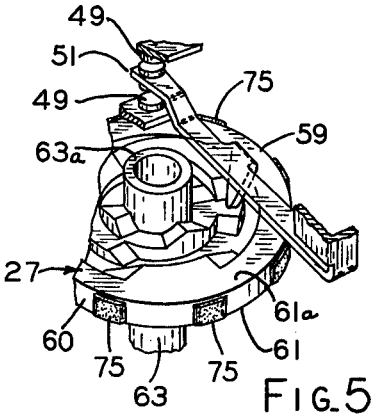
FIG. 5 is a fragmentary perspective view of the switch operator of FIGS. 2 – 4 illustrating its controlling engagement with one of the switch arms of FIG. 3.
Figure 6:
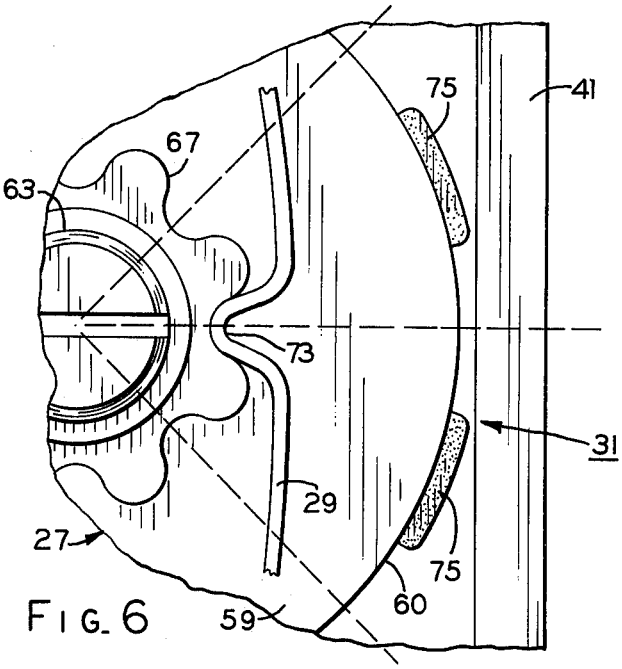
FIG. 6 is a greatly enlarged fragmentary view taken from FIG. 2 illustrating the effect of retarding means of the electrical switch with respect to the rotation of the switch operator between its switch operating positions.

Switches 25, **25*a*, 25*b*, FIGS. 3 and 5 are each provided with stationary contacts 49 for circuit making and breaking engagement with a movable contact 51 carried on a resilient, current carrying, metallic switch arm or blade 53. Thus, as shown, switch 25 is single throw, and switches 25*a*, 25*b* are double throw having pairs of spaced apart, opposite stationary contacts 49, as illustrated also in FIG. 5. Stationary contacts 49 are disposed in receptable chamber 35 generally in spaced relation along end wall 43 adjacent base wall 39, and the stationary contacts are mounted to metallic terminals 55, 55*a*, 55*b* which are molded or otherwise disposed in the base wall extending exteriorly of housing 23 for connection in a plurality of electrical circuits (not shown). Stationary contact 49 of single throw switch 25 is mounted to terminal 55, and the opposite stationary contact pairs of double throw switches 25*a*, 25*b* are mounted to terminals 55i a, 55*b*, respectively. The end of each switch blade 53 opposite its movable contact 51 is connected with terminals 57 which are disposed generally in spaced relation along end wall 43*a*, and terminals 57 are molded or otherwise disposed in base wall 39 extending exteriorly of housing 23 for connection in the above-mentioned plurality of separate circuits (not shown). While switches 25, 25*a*, 25*b*** are shown and described for purposes of disclosure, it is contemplated that switches of other types and arranged in another manner may be utilized within the scope of the invention.

Figure 4:
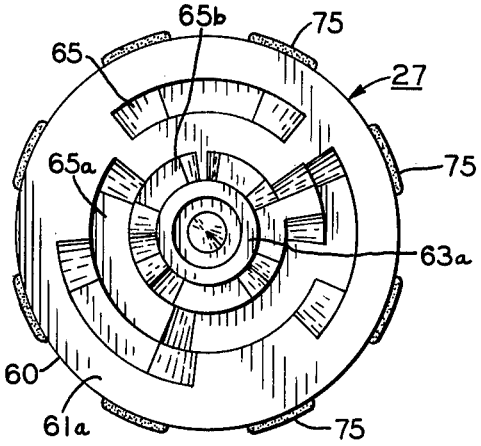
FIG. 4 is a fragmentary view showing a cam or switching means operating side of a switch operator for the electrical switch of FIG. 2.

Switch operator 27 is provided with a generally cylindric flange 59 having a peripheral portion of surface 60 intersected by a pair of opposite, generally radially extending, upper and lower faces 61, **61*a*, and a pair of oppositely extending upper and lower shafts or stems 63, 63*a* are integrally formed with the flange faces generally perpendicular thereto and centrally thereof, as shown in FIGS. 2 and 5. A plurality of generally annular cam configurations 65, 65*a* and 65*b*, as also shown in FIG. 4, are integrally provided on lower face 61*a* of flange 59 about lower stem 63*a* for actuating or operating engagement with following switch blades 53 of switches 25, 25*a*, 25*b*, respectively. When switch operator 27 is assembled or disposed within chamber 35 of receptacle 33, lower stem 63***a* of the switch operator is rotatably mounted and contained within recess 45 in receptacle base wall 39, and cam configurations 65, 65*a* and 65*b* on lower face 61*a* of the switch operator are disposed in their respective operating or driving engagements with switch blades 53 of switches 25, 25*a* and 25*b*, respectively. While cam configurations 65, 65*a*, 65*b* are shown and described for purposes of disclosure, it is contemplated that other types of cam configurations or drivers for switches 25, 25*a*, 25*b* may be provided on switch operator 27 and arranged in different manners within the scope of the invention. As shown in FIG. 2, *a* plurality of detents or notches 67 are disposed in generally annular spaced relation about switch operator 27 being integrally formed with upper stem 63 adjacent upper face 61 thereof, and the detents are associated with indexing springs 29, 29*a* to define the indexed or switch operating positions of the switch operator with respect to switches 25, 25*a* and 25*b*, as discussed in greater detail hereinafter. An annular shoulder 69 is also provided on upper stem 63 for abutting engagement with cover 37 about a centrally located aperture (not shown) therein to generally maintain switch operator against vertical displacement from housing 23, and the free end of the upper stem is rotatably received within such aperture extending therethrough exteriorly of the housing to receive operating knob 71, as shown in FIG. 1. While indexing springs 29, 29*a* and cooperating detents 67 are described and shown for purposes of disclosure, it is contemplated that other indexing means of various constructions may be utilized for indexing switch operator 27 within the scope of the invention so as to be generally commensurate with the objects and advantageous features thereof.

For controlling the indexing or switch operating positions of switch operator 27 upon the applied force rotation thereof, yieldable means or indexing springs 29, 29*a* are provided being disposed generally in recess 47 of cover 37 and supported by the cover, as shown in FIG. 2. Indexing springs 29, 29*a* are provided with opposed projections or abutments 73, 73*a* facing generally inwardly or toward each other, and the indexing spring projections cooperate in spring-like fashion with detents 67 of switch operator 27 to index or control the applied force rotation of the switch operator. In other words, the indexing or releasable holding engagement of indexing spring projections 73, 73*a* with detents 67 is operable generally to hold or maintain switch operator 27 in each of its switch operating positions, as also illustrated in FIG. 6. Upon the applied force rotation of switch operator 27, indexing springs 29, 29*a* are yieldable to release projections 73, 73*a* from their holding engagement with associated ones of detents 67 so as to permit the rotation of successive ones of the detents into holding engagement with the indexing spring projections. In this manner, the cooperating of projections 73, 73*a* on indexing springs 29, 29*a* with detents 67 distinctly define the indexing or switch operating positions of switch operator 27. If greater detail of the constructions and operations of the component parts of electrical switch 21, as discussed hereinabove, is desired, reference may be had to U.S. pat. No. 3,198,893.

Referring again in general to the drawings and recapitulating, at least in part, with respect to the foregoing discussion, electrical switch 21 (FIGS. 1–3) has a plurality of circuits therethrough, as may be exemplified by switches 25, 25*a* 25*b* (FIG. 3) for instance, and means, such as switch operator 27 (FIG. 2, 4–6), is adapted to be rotated in response to an applied force for controlling the making and breaking of the circuits. An indexing system (FIGS. 2, 6) for electrical switch 21 defines the plurality of indexed or switch operating positions of the controlling means or switch operator 27 which is operable generally to make at least one of the circuits in each of the switch operating positions thereof. The indexing system includes means, such as indexing springs 29, 29*a* (FIG. 2), associated with detents 67 of switch operator 27 for releasably holding it in each of its switch operating positions (FIG. 6 and also the retarding means 31, as discussed hereinafter, for retarding engagement between the switch operator and an associated part, such as receptacle sidewall 41 for instance (FIGS. 2, 6). Retarding means 31 operates so as to increase the total mechanical and electrical transfer times of switch operator 27 in its travel from one of its indexed positions toward another thereof without affecting the operation of the releasable maintaining means or indexing springs 29, 29*a* when the applied force, having a magnitude great enough to effect the release of the indexing springs, is exerted on the switch operator to rotate it between its indexed positions.

More particularly and with specific reference to FIGS. 2 and 6, retarding means 31 includes a plurality of means, such as friction elements, pads, strips or the like 75, which are disposed or otherwise mounted by suitable means (not shown) generally in spaced relation about peripheral portion 60 on flange 59 of switch operator 27 for frictional engagement with sidewalls 41, 41*a* of receptacle 33 when the switch operator is rotated from one of its switch operating positions toward another thereof. It may be noted that friction elements 75 are predeterminately spaced from each other and radially aligned generally arcuately between adjacent detents 67 so as to frictionally engage receptacle sidewalls 41, 41*a* only during a predetermined portion of the arcuate travel of switch operator between its switch operating positions. For instance, the indexing rotation of switch operator 27 between its switch operating positions is controlled by the association of indexing springs 29, 29*a* with detents 67, as previously mentioned, and the spaced relation of friction elements 75 about the switch operator is correlated with the arcuate spaced relation of the detents so as to be predeterminately spaced between adjacent or successive ones of the detents. In this manner, as switch operator 27 is rotated from one of its switch operating positions to another thereof, diametrically opposite pairs of friction elements 75 are rotated into frictional engagement with receptacle sidewalls 41, 41*a* thereby to frictionally retard the angular acceleration or velocity of the applied force rotation of the switch operator between its switch operating positions. This frictional engagement between friction elements 75 and receptacle sidewalls 41, 41*a* increases the mechanical and the electrical transfer times for effecting switching which reduces the possiblity of arcing between switches 25, 25*a*, 25*b*, i.e., the making of one of switches 25, 25*a*, 25*b* by switch operator 27 upon the applied force rotation thereof with respect to its breaking of another of the switches, as discussed hereinafter. It may be noted that due to the predetermined spaced relation of friction elements 75 with respect to detents 67, the retarding frictional engagement of the friction elements with receptacle sidewalls 41, 41*a* occurs only after an initial predetermined arcuate travel or distance of switch operator 27 away from one of its switch operating positions and is terminated a subsequent predetermined arcuate travel or distance spaced from a successive one of the switch operating positions toward which the switch operator is moved (as best seen in FIG. 6).

In the operation of electrical switch 21 with the components thereof positioned as discussed above and as shown in the drawings, an applied force may be manually exerted on operating knob 71, FIG. 1, to drive or rotate switch operator 27 in either a clockwise or a counterclockwise direction, as best seen in FIG. 2. When the applied force attains a magnitude great enough to overcome the compressive force of indexing springs 29, 29*a*, switch operator 27 is rotated with an initial acceleration proportional to the magnitude of the applied force from one of its switch operating positions toward another or successive one thereof wherein projections 73, 73*a* are cammed or displaced from the ones of detents 67 associated therewith into holding or indexing engagement with the next successive ones of the detents. Since cam configurations 65, 65*a*, 65*b* on lower face 61*a* of switch operator 27 are operatively or drivingly engaged with switch blades 53 of switches 25, 25*a*, 25*b*, respectively, the applied force rotation of the switch operator between its switch operating positions is effective to move the switch blades toward positions respectively making or breaking movable contacts 51 with associated stationary contacts 49 of the switches thereby to control the energization and de-energization of the electrical circuits through electrical switch 21 in a preselected manner, FIGS. 3 and 5. After a predetermined initial arcuate travel of switch operator 27 between its switch operating positions at the aforementioned initial angular acceleration, diametrically opposite pairs of friction elements 75 are rotated into frictional engagement with receptacle sidewalls 41, 41*a*, and this frictional engagement is effective to retard the applied force rotation of the switch operator thereby to reduce the initial angular acceleration thereof (as best seen in FIGS. 2 and 6). Of course, the retarding frictional engagement of friction elements 75 with receptacle sidewalls 41, 41*a* is maintained throughout a predetermined portion of the arcuate travel of switch operator 27 between its switch operating positions. When switch operator 27 is rotated through the predetermined portion of its arcuate travel frictionally engaging friction elements 75 with receptacle sidewalls 41, 41*a*, the friction elements are conjointly rotated toward positions disengaged from the receptacle sidewalls, and thereafter, the switch operator is rotated through a terminal portion of its arcuate travel between its switch operating positions with an angular acceleration or velocity proportional to the applied force effecting the rotation of the switch operator. As switch operator 27 approaches the switch operating position toward which it is being rotated, the compressive forces of indexing springs 29, 29*a* are effective to re-engage projections 73, 73*a* thereof with successive ones of detents 67 defining the switch operating position toward which the switch operator is being moved. Of course, with indexing spring projections 73, 73*a* again disposed in holding engagement with detents 67, the switching operation of switch operator 27 is completed, and indexing springs 29, 29*a* are effective to maintain the switch operator 27 in its adjusted or selected switch operating position wherein the applied force may be eliminated from operating knob 71. While the operation of electrical switch 21 is discussed above with the applied force rotation of switch operator being from one of its switch operating positions to the next successive one thereof, it is apparent that the switch operator may be rotatably moved through any desired number of its switch operating positions, and of course, retarding means 31 will be operable between each successive switch operating position of the switch operator to retard its angular acceleration in the same manner as previously described.

A method, in one form of the invention, is set out in the foregoing discussion for operating electrical switch 21 in which switch operator 27 is adapted for rotation in housing 23 between a plurality of distinct operating positions. This operating method includes applying a force to switch operator 27 for rotating it from one of its switch operating positions toward another thereof and retarding the applied force rotation of the switch operator only during a preselected portion of its rotation between its one and other switch operating positions.

It may also be noted that a method, of making electrical switch 21 is also set out in the foregoing discussion wherein switch operator 27 is adapted for rotation in housing 23 between a plurality of switch operating positions and means, such as indexing springs 29, 29*a*, are adapted for releasably holding the switch actuator in each of its switch operating positions. The making method includes assembling means, such as friction elements 75, to one of housing 23 and switch operator 27 for retarding engagement with the other of the housing and the switch actuator and, then, disposing the switch actuator for rotation in the housing so that the retarding means or friction elements 75 is engaged between the switch operator and the housing only during a predetermined portion of the rotation of the switch operator from one of its switch operating positions toward another thereof.

Figure 7:
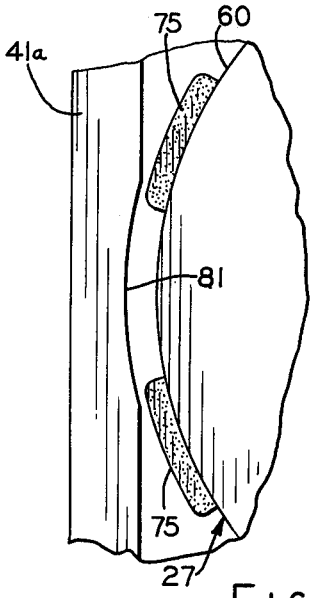
FIG. 7 is a fragmentary view taken from FIG. 2 illustrating an alternative construction for the electrical switch thereof.

Referring now to FIG. 7, an alternative construction in one form of the invention is also shown for electrical switch 21. It may be seen that receptacle sidewall 41*a* is provided with means 81 such as a recess for permitting the passage of friction elements 75 without frictional engagement thereof with receptacle side-wall 41*a* upon the applied force rotation of switch operator 27. With recess 81 provided to obviate frictional engagement between friction elements 75 and receptacle sidewall 41*a*, the friction elements frictionally engage only the other receptacle sidewall 41, as previously described. In addition to the objects and features set out hereinbefore for electrical switch 21, this alternative construction of FIG. 7 provides at least the additional objects and feature of reducing the retarding effect of the frictional engagement between frictional elements 75 of switch operator 27 and housing 23 thereby to alter the range through which the angular acceleration of the switch operator may be effectively controlled.

Figure 8:
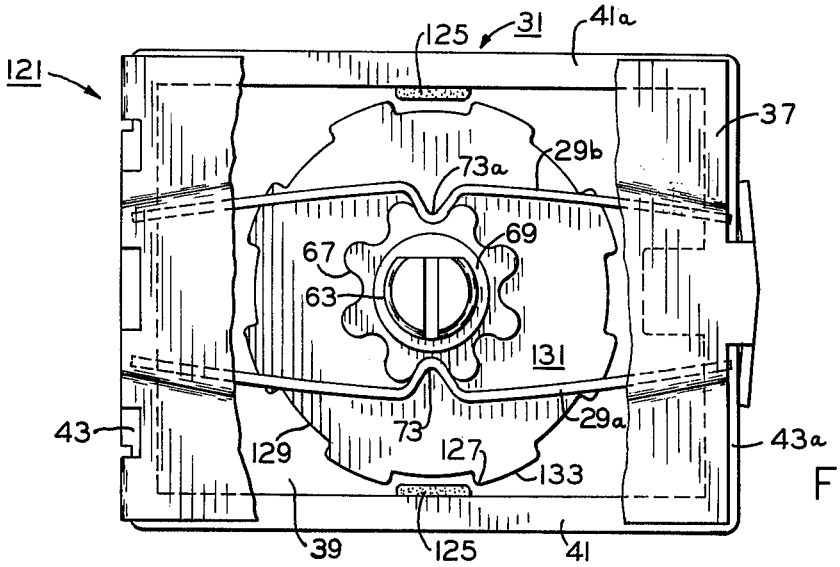
FIG. 8 is a top elevational view of an alternative electrical switch, in one form of the invention, with a cover therefor partially broken away to show the operating components which illustrate an alternative indexing system, in one form of the invention, as well as teaching principles of an alternative operating method in one form of the invention.

In FIG. 8, an alternative electrical switch 121 in one form of the invention is shown having generally the same component parts and operating generally in the same manner as the previously described electrical switch 21 with the exceptions set out hereinafter; however, it may be noted that electrical switch 121, as well as having at least some of the advantages and objects set out above with respect to electrical switch 21, also incorporates additional advantages and objects which will be in part apparent and in part pointed out hereinafter.

Retarding means 31 of electrical switch 121 includes means, such as a friction element, pad, strip or the like 125, disposed or otherwise mounted by suitable means (not shown) to receptacle sidewall 41 for frictional engagement with a plurality of means, such as extensions 127, integrally formed on a peripheral portion 129 of a switch operator 131 which otherwise has generally the same component parts as the previously discussed switch operator 27 of electrical switch 21. Extensions 127 are predeterminately spaced apart and aligned generally arcuately between detents 67 so as to frictionally engage friction element 125 on receptacle sidewall when switch operator 131 is rotated from one of its switch operating positions toward another thereof. It may be noted that a plurality of generally arcuate surfaces 133 are respectively provided on the free ends of extensions 127 for frictionally engaging friction element 125. Due to the spacing of extensions 127 between the switch operating or indexed positions of switch operator 131, it may also be noted that extension surfaces 133 are frictionally engaged with the friction element only during a predetermined portion of the applied force rotation or arcuate travel of the switch operator between its switch operating positions thereby to retard the angular acceleration of the switch operator in response to the applied force rotation thereof. Of course, another one of friction element 125 could be similarly disposed on receptacle sidewall 41*a* for frictional engagement with friction surfaces 133, if desired, which would serve to further retard the angular acceleration of switch operator 131.

Alternative constructions are shown in FIGS. 9–13 with respect to an electrical switch 221, in one form of the invention, which has generally the same component parts functioning generally in the same manner as the previously discussed switches 21, 121 with the exceptions discussed hereinafter. It is believed that electrical switch 221 includes at least some of the advantageous features and objects discussed hereinabove with respect to electrical switches 21, 121 as well as additional advantageous features and objects which will be in part apparent and in part pointed out hereinafter.

Figure 9:
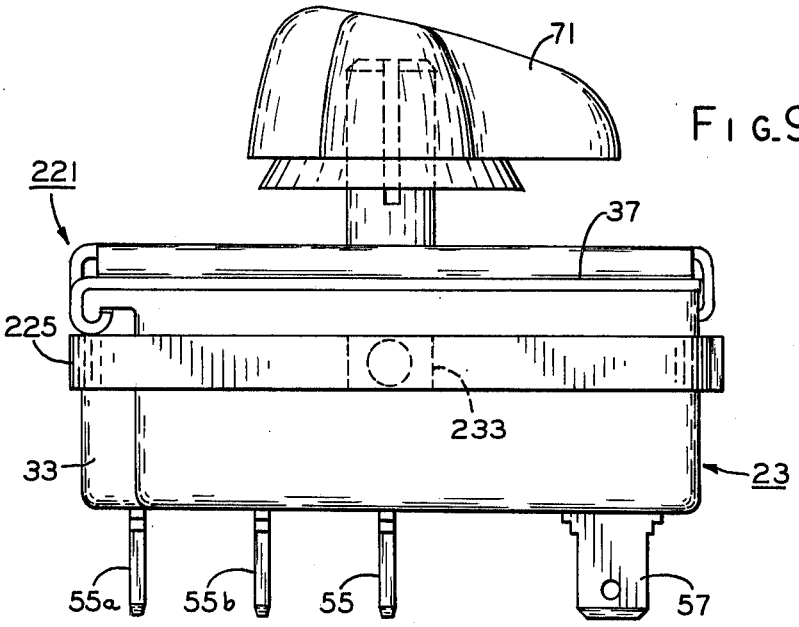
FIG. 9 is a side elevational view of another alternative electrical switch in one form of the invention.
Figure 10:
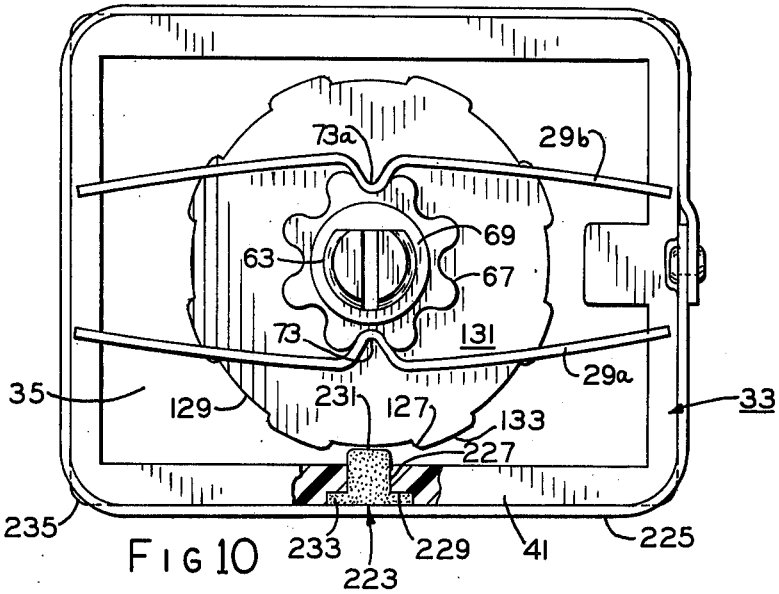
FIG. 10 is a top elevational view of the electrical switch of FIG. 9 with a cover therefor partially broken away thereby to show operating components of the electrical switch which illustrate an alternative indexing system, in one form of the invention, as well as teaching principles of an alterntive operating method in one form of the invention.

Referring now in general to FIGS. 9–13 and recapitulating at least in part with respect to the foregoing discussion, electrical switch 221 is provided with housing 23 (FIGS. 9, 10), and switch operator 131 is disposed in the housing for rotation in response to an applied force between a plurality of switch operating positions (FIG. 10). Retarding means 31 (FIGS. 10–13) for retarding the applied force rotation of switch operator 131 includes at least one friction element 223 movably mounted in housing 23, a plurality of means, such as extensions 127, on the switch operator for frictionally engaging that at least one friction element upon the applied force rotation of the switch operator from one of its switch operating positions toward another thereof (FIG. 10), and means, such as a yieldable band 225 (FIGS. 9, 10), a leaf spring 225*a* (FIG. 11), or a conical spring 225*b* (FIGS. 12, 13), for opposing movement in the housing of the at least one friction element upon the frictional engagement therewith of the frictional engaging means.

More particularly and with specific reference to FIG. 10, an opening, such as a stepped bore 227 having a shoulder 229 therebetween, is provided through sidewall 41 of housing receptacle 33, and friction element 223 is movably mounted in the opening. Friction element 223 is provided with a pair of opposite ends or end portions 231, 233, and end 231 of friction element 223 is disposed in chamber 35 for frictional engagement with extensions 127 of switch operator 131 as it is moved between its switch operating positions. End 233 of friction element 233 may, if desired, be enlarged thereby to generally comprise a head, and the opposing means, such as expansible or resilient band 225, normally engages head or end 223 of the friction element and urges it toward abutting engagement with shoulder 229 formed on receptacle sidewall 41. With the exterior end or head 233 of friction element 233 so engaged with shoulder 229, interior or free end 231 of the friction element may be disposed generally adjacent or in close spaced relation with peripheral portion 129 of switch operator 131 between adjacent extensions 127 thereof when the switch operator is releasably held in one of its switch operating positions by the cooperative action of the indexing springs 29, 29*a* with detents 67, as previously mentioned. Upon the applied force of rotation of switch operator 131 between its switch operating positions, a leading or ramp edge of extensions 127 initially engages interior end 231 of frictional element 223 camming or driving it against the compressive force of band 225 until frictional face 133 of the extension is rotated into frictional engagement with the interior end of the friction element. In this manner, both the movement of friction element 223 by the ramp edge of extensions 127 against resilient band 225 and the frictional engagement between the friction surface 133 and interior end 231 of the friction element are operable generally to effect the retardation of the angular acceleration imparted to switch operator 131 by the applied force rotation thereof between its switch operating positions. It may also be noted that the resiliency of band 225 alleviates, at least to some extent, the reaction force against the applied force rotation of the switch operator caused by the engaging of extensions 127 with interior end 231 of friction element 223.

As shown in FIGS. 9 and 10, receptacle 33 of housing 23 may be notched or recessed, as shown generally at 235, at the external corners of the receptacle to receive and retain band 225 against displacement. While band 225 has been shown as extending entirely about the periphery of receptacle 33 with the ends of the band interconnected for purposes of disclosure, it is contemplated that other types of resilient bands may be utilized within the scope of the invention. For instance, band 225 may be interrupted so as to have opposite end portions (not shown) which may be snapped, crimped, or otherwise disposed in displacement preventing engagement with cooperative parts (not shown) of the housing.

Figure 11:
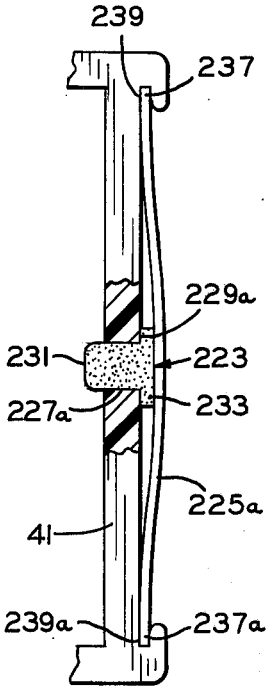
FIG. 11 is a fragmentary view taken from FIG. 10 and illustrating an alternative construction for the electrical switch thereof.

In FIG. 11, an opening, generally constituted by a bore 227*a*, is provided through sidewall 41 of receptacle 33, and friction element 223 is movable in the bore with head 233 of the friction element engaged with a shoulder 229*a* on the sidewall extending generally about the bore therein. Leaf spring 225*a* has its intermediate portion biased into engagement with head 233 of friction element 223, and a pair of opposite ends 237, 237*a* are provided on the leaf spring being received and contained in a pair of opposite recesses 239, 239*a* provided in the exterior side of receptacle sidewall 41. Leaf spring 235*a* acts generally in the same manner as the previously discussed band 225 for urging friction element 231 generally toward switch operator 131 for frictional engagement with extensions 127 thereof upon the applied force rotation of the switch operator from one of its switch operating positions toward another thereof.

Figure 12:
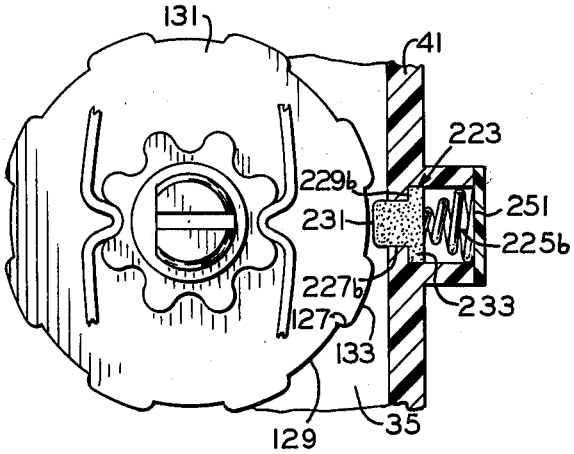
FIGS. 12 and 13 are enlarged fragmentary views taken from FIG. 10 and illustrating another alternative construction for the electrical switch thereof.
Figure 13:
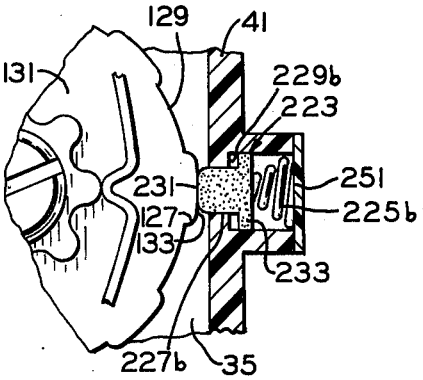
Figure 14:
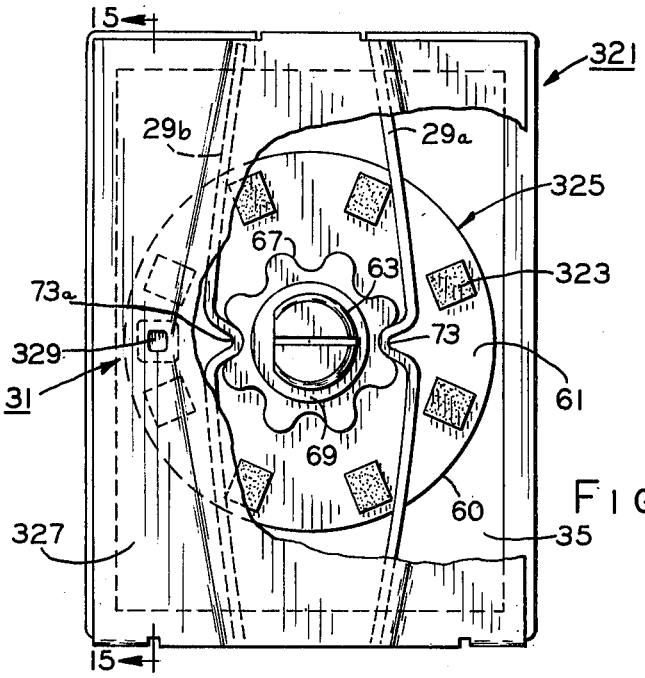
FIG. 14 is a top elevational view of an alternative electrical switch, in one form of the invention, with a cover therefor partially broke away to show the operating components which illustrate an alternative indexing system, in one form of the invention, as well as teaching principles of an alternative operating method in one form of the invention.
Figure 15:
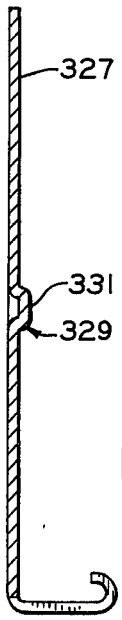
FIG. 15 is a sectional view of the cover for the electrical switch of FIG. 14.

Referring now to FIGS. 12 and 13 with respect to electrical switch 221 to illustrate an alternative construction therefor, it may be seen that receptacle sidewall 41 is recessed at 251, and an opening, such as a stepped bore **227*b* having shoulder 229*b* therebetween, is provided in the receptacle sidewall between the recess and housing chamber 35. Friction element 223 is slidably received in opening 227*b* having its interior end 231 within housing chamber 35 for frictional engagement with friction surfaces 133 on extensions 127 of switch operator 131, and head 233 of the friction element is disposed within recess 251. Head 233 of friction element 223 is slidably guided in recess 251, and conical spring 225*b* or the like, is disposed in the recess being biased between a part of sidewall 41 defining the recess and the friction element head. The compressive force of spring 225*b* urges friction element head 233 toward engagement with shoulder 229*b* generally about opening 227*b* thereby to prevent displacement of friction element 223 from the opening. With head 233 of friction element 223 so engaged with shoulder 229*b*, interior end 231 of the friction element may be disposed generally adjacent or in close spaced relation with peripheral portion 129 of switch operator 131 between adjacent extensions 127 thereof when the switch operator is releasably held in one of its switch operating positions by the cooperative action of indexing springs 29, 29*a* with detents 67, as previously mentioned. Upon the applied force rotation of switch operator 131 between its switch operating positions, a leading side or ramp edge of extension 127 initially engages interior end 231 of friction element 223 camming or driving it against the compressive force of spring 225*b* until friction face 133 of the extension is rotated into frictional engagement with the interior end of the friction element, as shown in FIG. 13. In this manner, both the movement of friction element 223 by the ramp edge of extension 127 against spring 225*b* and the frictional engagement between the friction surface 133 and interior end 231 of the friction element are operable generally to effect the retardation of the angular acceleration imparted to switch operator 131 by the applied force rotation thereof between switch operating positions. It may also be noted that wear of friction element 223 due to the frictional engagement thereof with extensions 127 of switch operator 131 is compensated by the biasing action of spring 225*b*. In other words, when such frictional engagement wear is occasioned, spring 225*b* will urge frictional element 223 leftwardly (as best seen in FIG. 13) to ensure the engagement of friction element interior end 231 with the friction surfaces 133 of extensions 127 until head 233 of the friction element engages housing shoulder 229*b***.

Referring now to FIGS, 14 and 15, an alternative electrical switch 321 in one form of the invention is shown having generally the same component parts and operating generally in the same manner as the previously described electrical switch 21 with the following discussed exceptions. It may be noted that electrical switch 321 incorporates additional advantages and objects, as well as at least some of those discussed above with respect to electrical switch 21, which will be in part apparent and in part pointed out hereinafter.

Retarding means 31 of electrical switch 321 includes means such as a plurality of friction elements, pads, strips or the like 323, disposed or otherwise mounted by suitable means (not shown) about upper face 61 adjacent peripheral portion 60 of a switch operator 325 which otherwise has generally the same component parts as the previously discussed switch operator 27 of electrical switch 21. A cover 327 for electrical switch 221 has an integrally formed extension 329 depending therefrom toward chamber 35 with a friction surface 331 thereon for frictional engagement with frictional elements 323, and friction surface 331 is also included in retarding means 31 of electrical switch 321. Friction elements 323 are arcuately spaced between the switch operating positions of switch operator 325 so as to engage friction surface 331 only during predetermined portions of the applied force rotation of the switch operator between its switch operating positions, as previously discussed. Of course, if desired, at least another friction surface (not shown) similar to friction surface 331 could be provided on cover 327 for frictional engagement with friction elements 323.

Figure 16:
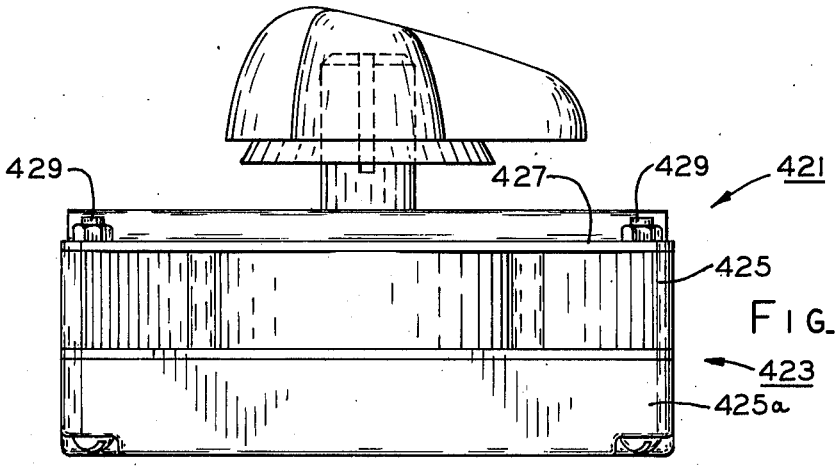
FIG. 16 is a side elevational view of another alternative switch in one form of the invention.
Figure 17:
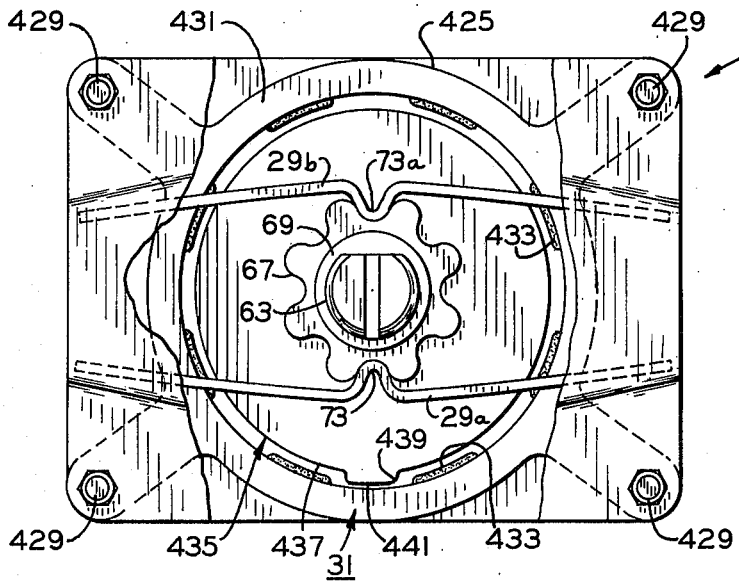
FIG. 17 is a top elevational view of the electrical switch of FIG. 16 with a cover thereof partially broken away to show operating components which illustrate an alternative indexing system, in one form of the invention, as well as teaching principles of an alternative operating method in one form of the invention.

Another alternative electrical switch 421 in one form of the invention is shown in FIGS. 16 and 17 having generally the same component parts and operating generally in the same manner as the previously discussed electrical switch 21 with the following exceptions discussed below; however, it may be noted that in addition to at least some of the advantages and object discussed with respect to electrical switch 21, electrical switch 421 may also have other advantages and objects which will be in part apparent and in part pointed out hereinafter.

Electrical switch 421 has a housing 423 generally comprising a pair of mating upper and lower receptacles **425, 425*a* and a cover 427 which are interconnected against displacement by suitable means, such as plurality of nut and bolt assemblies 429 for instance. Switches 25, 25*a*, 25*b* may be contained in lower receptacle 425*a*, and upper receptacle 425 is provided with a generally annular sidewall 431. Retarding means 31 of electrical switch 421 includes means, such as a plurality of friction elements, pads, strips or the like 433, disposed or otherwise mounted by suitable means (not shown) to sidewall 431 in predetermined arcuate spaced relation thereabout. A switch operating member 435 has a peripheral portion 437 with an integral extension 439 extending generally therefrom, which is also included in retarding means 31 of electrical switch 431, and a friction surface 441 is provided on the free end of the extension for frictional engagement with the friction elements. Otherwise switch operator 435 has generally the same component parts as the previously discussed switch operator 27 of electrical switch 21. Friction elements 433 are arcuately spaced between the switch operating positions of switch operator 435 so as to be frictionally engaged by friction surface 441 of the switch operator only during predetermined portions of the applied force rotation of the switch operator between its switch operating positions, as previously discussed. Of course, if desired, at least another extension and friction surfaces (not shown) similar to extension 439 and friction surface 441 may be provided on switch operator 435 for frictional engagement with friction elements 433**.

While electrical switches 21, 121, 321 and 421 are shown and described herein as having a plurality of friction elements 75, 125, 323 and 433 for purposes of disclosure, it is contemplated that as few as one friction element could be employed within the scope of the invention so as to generally conform with the objects and advantageous features of the invention as set out herein. Further, electrical switches 121, 221 are shown and described herein as having a plurality of extensions 133 on their switch operators 131, but it is contemplated that as few as one extension may be employed within the scope of the invention so as to be generally commensurate with the objects and advantageous features of the invention as set out herein.

Figure 18:
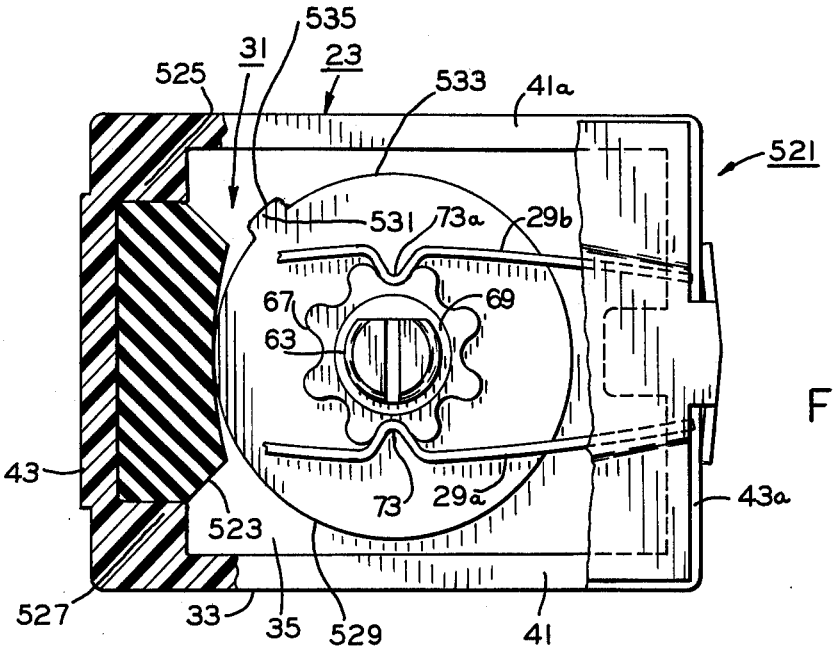
FIG. 18 is a top elevational view of an alternative electrical switch, in one form of the invention, with a cover therefor partially broken away to show the operating components which illustrate an alternative indexing system, in one form of the invention, as well as teaching principles of an alternative operating method in one form of the invention.

Referring now to FIG. 18, another alternative electrical switch 521 in one form of the invention is shown having generally the same component parts and operating generally in the same manner as the previously discussed electrical switch 121 with the following exceptions discussed below; however, it may be noted that in addition to at least some of the advantages and objects discussed at least with respect to electrical switch 121, electrical switch 521 may also have other advantages and objects which will be in part apparent and in part pointed out hereinafter.

Retarding means 31 of electrical switch 521 includes means, such as a friction element, block, pad, strip or the like 523 which may be formed of any suitable friction material, such as a block of silicon or other type rubber if desired. In its generally block form or shape, friction element or block 523 is fitted into one end receptacle 33 adjacent sidewall 43 thereof, and if desired, spacers or retainers 525, 527 may be provided within housing chamber 35 so as to predeterminately position the friction block with respect to switch operator 529 of electrical switch 521. As shown, spacers 525, 527 are integral with housing 23 of electrical switch 521; however, such spacers may be separate from the housing and fitted therein in any manner as desired. Switch operator 529 in generally the same as that discussed hereinabove with respect to electrical switch 121 except that switch operator 529 has only one extension 531 on its peripheral edge or portion 533 with a friction surface 535 for frictional engagement with friction block 523. Extension 531 is disposed or formed on peripheral edge 533 of switch operator 529 so as to be aligned generally arcuately between a selected pair of detents 67. When switch operator 529 is manually rotated between the switch operating positions defined by the selected pair of detents, friction surface 535 of extension 521 is frictionally engaged with friction block 523 only during a predetermined portion of the manual or applied force rotation or arcuate travel of the switch operator between its selected pair of switch operating positions thereby to retard the angular acceleration of the switch operator in response to the applied force rotation thereof.

From the foregoing, it is now apparent that novel electrical switches 21, 121, 221, 321, 421, and 521, methods of operating an electrical switch, and indexing systems for an electrical switch have been provided meeting the objects and advantages set out hereinbefore, as well as others. Further, it is contemplated that changes or alterations as to the precise arrangements, shapes, details and connections of the component parts of the invention disclosed herein, as well as the precise steps of the disclosed methods of the invention, may be made by those having ordinary skill in the art without departing from the spirit of the invention or scope thereof as set out by the claims which follow.

What I claim as new and desire to secure by Letters Patent of the United States is:

1. An electrical switch comprising a housing, means operable generally for switching power through the switch, means rotatable in the housing between a plurality of indexed positions for actuating the switching means, means for releasably holding the actuating means in each of its indexed positions, and means operable independently of said releasably holding means for retarding the rotation of the actuating means between at least some of its indexed positions.

2. An electrical switch as set forth in claim 1, wherein the retarding means includes means associated with one of the actuating means and the housing for frictional engagement with the other of the actuating means and the housing.

3. An electrical switch as set forth in claim 1, wherein the retarding means includes a plurality of means spaced generally about the periphery of the actuating means for frictional engagement with at least one associated part of the housing upon the rotation of the actuating means from one of its indexed positions toward another thereof.

4. An electrical switch as set forth in claim 1, wherein the retarding means includes a plurality of friction elements on the actuating means at least adjacent the periphery thereof, the elements being movable into frictional engagement with at least one associated part of the housing upon the rotation of the actuating means from at least one of its indexed positions toward another thereof.

5. An electrical switch as set forth in claim 1, wherein the retarding means includes means associated with the housing for frictional engagement with at least one portion of the actuating means extending therefrom at least adjacent the periphery of the actuating means upon the rotation of the actuating means from at least one of its indexed positions toward another thereof.

6. An electrical switch as set forth in claim 1, wherein the retarding means include a plurality of spaced apart friction elements disposed in the housing, and at least one extension on the actuating means for frictional engagement with the friction elements as the actuating means is rotated from at least one of its indexed positions toward another thereof.

7. An electrical switch as set forth in claim 1, wherein the retarding means include at least one friction element disposed in the housing, and a plurality of means on the actuating means for respective frictional engagment with the at least one friction element upon the rotation of the actuating means from one at least of its indexed positions toward another thereof.

8. An electrical switch comprising a housing having at least one wall; a switch operating member rotatably mounted in the housing including a peripheral portion spaced from the one wall, and a plurality of detents on the switch operating member disposed in generally annular relation thereabout; resilient means mounted to the housing including an abutment portion for releasable holding engagement with the detents, the resilient means being operable generally to urge the abutment portion toward engagement with the switch operating member and toward the releasable holding engagement with each of the detents thereby to respectively define indexed positions of the switch operating member upon its rotation in response to a force applied thereto; and means for retarding the angular velocity of the applied force rotation of the switch operating member between its indexed positions including means associated with one of the switch operating member and the at least one wall for frictional engagement with the other of the switch operating member and the at least one wall only during a predetermined portion of the applied force rotation of the switch operating means from one of its indexed positions toward another thereof.

9. An electrical switch comprising a housing, a switch operator mounted in the housing for rotation in response to an applied force between a plurality of switch operating positions, yieldable means for indexing engagement with the switch operator and operable generally to releasably hold the switch operator in its switch operating positions, and means for retarding the angular velocity of the switch operator only during a predetermined portion of its applied force rotation from one of the switch operating positions toward another thereof.

10. An electrical switch as set forthh in claim 9, wherein the retarding means includes means associated with one of the switch operator and the housing for frictional engagement with the other of the switch operator and the housing.

11. An electrical switch as set forth in claim 10, wherein the frictional engagement means includes at least one friction element.

12. An electrical switch as set forth in claim 11, wherein the switch operator includes at least one extension adjacent the periphery of the switch operator for engagement with the at least one friction element, the at least one friction element being mounted in the housing.

13. An electrical switch as set forth in claim 9, wherein the retarding means includes a plurality of friction elements mounted in the housing so as to be disposed generally between the switch operating positions of the switch operator, and at least one extension on the switch operator for engagement with the friction element.

14. An electrical switch as set forth in claim 9, wherein the retarding means includes a plurality of friction means on the swtich operator so as to be disposed generally between the switch operating positions thereof for frictionally engaging at least one associated part of the housing.

15. A method of operating an electrical switch having a housing, and a switch operator adapted for rotation in the housing between a plurality of distinct switch operating positions comprising the steps of:

a. applying a force to the switch operator for rotating it from one of its switch operating positions toward another thereof; and retarding the applied force rotation of the switch operator during only a preselected portion of its rotation between its one and switch operating positions.

16. The method as set forth in claim 15, wherein the retarding step comprises moving means for frictional engagement associated with one of the switch operator and the housing into frictional engagement with the other of the switch operator and the housing.

17. The method as set forth in claim 15, wherein the retarding step comprises engaging a plurality of means for frictional engagement on the switch operator with at least one friction part on the housing.

18. The method as set forth in claim 15, wherein the retarding step comprises engaging means adapted for frictional engagement and disposed on the switch operator with a plurality of associated friction elements mounted in the housing.

19. The method as set forth in claim 15, wherein the retarding step comprises engaging a plurality of friction elements on the switch operator with at least one associated friction abutment on the housing.

20. A method of operating an electrical switch having a switch operator therein adapted for rotation between a plurality of switch operating positions, and means for releasably holding the switch operator in each of its switch operating positions comprising the steps of:

a. rotating the switch operator from one of its switch operating positions toward another thereof and driving the releasable holding means to effect its release as the switch operator is rotated; and b. retarding the angular velocity of the switch operator only during a predetermined portion of the switch operator rotation between its one and other switch operating positions.

21. An indexing system for an electrical switch having a plurality of circuits and means adapted to be rotated between a plurality of indexed positions in the switch in response to an applied force for controlling the making and breaking of the circuits, the indexing system comprising means engaged with the controlling means and operable generally for releasably holding it in each of its indexed positions, and means for retarding the rotation of the controlling means so as to increase the total mechanical and electrical transfer time of the controlling means in its travel from one of its indexed position toward another thereof without affecting the operation of said releasably maintaining means when the applied force having a magnitude great enough to effect the release of said releasable maintaining means is exerted on the controlling means to rotate it between its indexed positions.

22. An electrical switch comprising a housing, a switch operator disposed in the housing for rotation in response to an applied force between a plurality of switch operating positions, and means for retarding the applied force rotation of the switch operator including at least one friction element movably mounted in the housing, a plurality of means on the switch operator for frictionally engaging the at least one friction element upon the applied force rotation of the switch operator from one of its switch operating positions toward another thereof, and means for opposing movement in the housing of the at least one friction element upon the frictional engagement therewith of the frictionally engaging means.

23. An electrical switch as set forth in claim 22, wherein the opposing means comprises means for urging the at least one friction element generally toward the switch operator at least during the frictional engagement of the frictionally engaging means with the at least one friction element.

24. An electrical switch as set forth in claim 22, wherein the opposing means includes resilient means for connection between the housing and the at least one friction element.

25. An electrical switch as set forth in claim 22, wherein the at least one friction element includes a pair of opposite end portions respectively disposed interiorly and exteriorly of the housing, the interior end portion being adapted for the frictional engagement with the frictionally engaging means, and the opposing means being engaged with the exterior end portion.

26. An electrical switch as set forth in claim 25, wherein the opposing means includes resilient means for mounting engagement with the housing exteriorly thereof and engaged with the exterior end of the at least one friction element.

27. An electrical switch as set forth in claim 26, wherein the resilient means comprises a yieldable band extending at least partially about the periphery of the housing exteriorly thereof.

28. An electrical switch as set forth in claim 22, wherein the housing includes at least one sidewall having a recess therein, and an opening in the at least one sidewall communicating with the recess, the at least one friction element being movable in the recess and the opening, and the opposing means including resilient means disposed in the recess for biasing engagement between the at least one friction element and a part of the at least one sidewall defining the recess.

29. An electrical switch as set forth in claim 28, wherein the at least one friction element includes an enlarged head movable in the recess, the resilient means being engaged with the enlarged head.

30. An electrical switch as set forth in claim 28, wherein the at least one sidewall includes a shoulder in the recess and extending generally about the opening in the recess, the resilient means biasing the at least one friction element toward engagement with the shoulder.

31. A method operating an electrical switch having a housing, and a switch operator adapted for rotation in the housing between a plurality of switch operating positions comprising the steps of:

a. rotating the switch operator from one of its switch operating positions toward another thereof;
b. driving a portion of the switch operator into engagement with a friction element movably mounted in the housing so as to displace the friction element against means operable generally for biasing the friction element against such displacement; and
c. engaging a friction surface on the portion of the switch operator with the displaced friction element for retarding the switch operator only during a predetermined portion of its rotation between the one and another switch operating positions.

32. An indexing system for an electrical switch having switch operating means adapted for rotatable movement therein between a plurality of discrete switch operating positions, the indexing system comprising means associated with the switch operating means for releasably holding it in the switch operating positions thereof, and means operable independently of said releasably holding means for retarding the switch operating means only during a predetermined portion of its rotatable movement from one of the switch operating positions to another thereof.

33. An indexing system as set forth in claim 32 wherein the switch operating means has a plurality of means for defining the switch operating positions, said releasably holding means comprising yieldable means urged toward engagement with the defining means of the plurality thereof upon the rotatable movement of the switch operating means.

34. An indexing system as set forth in claim 32 wherein the electrical switch has a housing, said retarding means comprising means associated with one of the housing and the switch operating means and adapted for frictional engagement with at least an associated part of the other of the housing and the switch operating means during the predetermined portion of the rotatable movement of the switch operating means between its one and another switch operating positions.

35. An electrical switch comprising a housing, means operable generally for switching power through the switch, means rotatable in the housing between a plurality of indexed positions for actuating the switching means, means engaged with the actuating means during its rotation and operable generally for releasably holding the actuating means in each of its indexed positions, and a plurality of friction elements on the actuating means at least adjacent the periphery thereof, the friction elements being movable into frictional engagement with at least one associated part of the housing so as to retard the rotation of the actuating means from at least one of its indexed positions toward another thereof.

36. An electrical switch comprising a housing, means operable generally for switching power through the switch, means rotatable in the housing between a plurality of indexed positions for actuating the switching means, means engaged with the actuating means during its rotation and operable generally for releasably holding the actuating means in each of its indexed positions, and means associated with the housing for frictional engagement with at least one portion of the actuating means extending therefrom at least generally adjacent the periphery of the actuating means so as to retard the actuating means upon the rotation thereof from at least one of its indexed positions toward another thereof.

37. An electrical switch comprising a housing, means operable generally for switching power through the switch, means rotatable in the housing between a plurality of indexed positions for actuating the switching mens, means engaged with the actuating means during its rotation and operable generally for releasably holding the actuating means in each of its indexed positions, a plurality of spaced apart friction elements disposed in the housing, and at least one extension on the actuating means for frictional engagement with the friction elements so as to effect retardation of the actuating means as it is rotated from at least one of its indexed positions toward another thereof.

38. An electrical switch comprising a housing, means operable generally for switching power through the switch, means rotatable in the housing between a plurality of indexed positions for actuating the switching means, means engaged with the actuating means during its rotation and operable generally for releasably holding the actuating means in each of its indexed positions, at least one friction element disposed in the housing, and a plurality of means on the actuating means for respective frictional engagement with the at least one friction element so as to effect retardation of the actuating means upon its rotation from at least one of its indexed positions toward another thereof.

* * * * *

UNITED STATES PATENT AND TRADEMARK OFFICE

CERTIFICATE OF CORRECTION

PATENT NO. : 4,038,508

DATED : July 26, 1977

INVENTOR(S) : George C. Mapelsden

It is certified that error appears in the above-identified patent and that said Letters Patent are hereby corrected as shown below:

Column 15, line 9, delete "forthh" and insert - forth -

Column 15, line 27, delete "element" and insert - elements -

Column 15, line 44, before "switch" insert - another -

Column 17, lines 13 & 14, delete "in the recess"

Column 18, line 34, delete "mens" and insert - means -

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*